US010656601B2

(12) United States Patent
Cho et al.

(10) Patent No.: US 10,656,601 B2
(45) Date of Patent: May 19, 2020

(54) SMART WATCH AND METHOD FOR CONTROLLING SAME

(71) Applicant: LG ELECTRONICS INC., Seoul (KR)

(72) Inventors: Hangbeum Cho, Seoul (KR); Joohyun Yu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 196 days.

(21) Appl. No.: 15/741,970

(22) PCT Filed: Jan. 15, 2016

(86) PCT No.: PCT/KR2016/000452

§ 371 (c)(1),
(2) Date: Jan. 4, 2018

(87) PCT Pub. No.: WO2017/007100

PCT Pub. Date: Jan. 12, 2017

(65) Prior Publication Data

US 2018/0196396 A1 Jul. 12, 2018

(30) Foreign Application Priority Data

Jul. 9, 2015 (KR) ..... 10-2015-0097906

(51) Int. Cl.
*G04G 9/00* (2006.01)
*G04G 21/08* (2010.01)
(Continued)

(52) U.S. Cl.
CPC ..... *G04G 9/007* (2013.01); *G04B 1/12* (2013.01); *G04B 19/04* (2013.01); *G04C 10/00* (2013.01);
(Continued)

(58) Field of Classification Search
CPC ..... G04G 9/007; G04G 9/00; G04G 9/0094; G04G 21/08; G04B 1/12; G04B 19/04; G04C 10/00; G04C 10/04
(Continued)

(56) References Cited

U.S. PATENT DOCUMENTS 6,084,828 A 7/2000 Bland et al.
6,600,527 B1 7/2003 Basturk et al.
(Continued)

FOREIGN PATENT DOCUMENTS

CH 705561 3/2013
CN 1285057 2/2001
(Continued)

OTHER PUBLICATIONS

PCT International Application No. PCT/KR2016/000452, Written Opinion of the International Searching Authority dated Apr. 1, 2016, 39 pages.
(Continued)

*Primary Examiner* — Edwin A. Leon
(74) *Attorney, Agent, or Firm* — Lee, Hong, Degerman, Kang & Waimey

(57) ABSTRACT

A smart watch, which simultaneously provides the two functions of a physical watch and a mobile terminal, and a method for controlling the same are disclosed. The present invention provides a smart watch and a method for controlling the smart watch, the smart watch comprising; a case; at least one hand for displaying current time, the at least one hand being arranged to be adjacent to the inner periphery of the case; a movement for moving the hand along the inner periphery of the case, the movement being located inside the case; and a display unit configured to display various types of information, the display unit being located in the case,
(Continued)

wherein the hand and a screen of the display unit are simultaneously shown to a user.

20 Claims, 13 Drawing Sheets

(51) Int. Cl.
*G04B 19/04* (2006.01)
*G04C 10/00* (2006.01)
*G04B 1/12* (2006.01)
*G04C 10/04* (2006.01)

(52) U.S. Cl.
CPC ..... *G04C 10/04* (2013.01); *G04G 9/00* (2013.01); *G04G 9/0064* (2013.01); *G04G 9/0094* (2013.01); *G04G 21/08* (2013.01)

(58) Field of Classification Search
USPC ..... 368/225
See application file for complete search history.

(56) References Cited

U.S. PATENT DOCUMENTS

| | | | | |
|---|---|---|---|---|
| 7,035,170 | B2 * | 4/2006 | Narayanaswami .. | G04G 9/0082 368/10 |
| 2002/0036955 | A1 * | 3/2002 | Basturk ..... | G02F 1/1334 368/223 |
| 2003/0123329 | A1 * | 7/2003 | Guanter ..... | G04G 11/00 368/82 |
| 2009/0028005 | A1 | 1/2009 | You et al. | |
| 2011/0176395 | A1 | 7/2011 | Mooring | |
| 2015/0015502 | A1 | 1/2015 | Al-Nasser | |
| 2015/0078144 | A1 | 3/2015 | Gong | |
| 2015/0098309 | A1 | 4/2015 | Adams et al. | |

FOREIGN PATENT DOCUMENTS

| | | |
|---|---|---|
| CN | 101072245 | 11/2007 |
| CN | 101449216 | 6/2009 |
| CN | 202995285 | 6/2013 |
| CN | 103472708 | 12/2013 |
| CN | 203422565 | 2/2014 |
| CN | 103823354 | 5/2014 |
| CN | 104375774 | 2/2015 |
| CN | 204440022 | 7/2015 |
| EP | 2838008 | 2/2015 |
| KR | 1020090011113 | 2/2009 |

OTHER PUBLICATIONS

State Intellectual Property Office of the People's Republic of China Application Serial No. 201680040206.4, Office Action dated Jun. 17, 2019, 14 pages.

European Patent Office Application Serial No. 16821506.9, Search Report dated Apr. 10, 2019, 7 pages.

* cited by examiner

SMART WATCH AND METHOD FOR CONTROLLING SAME

CROSS-REFERENCE TO RELATED APPLICATIONS

This application is the National Stage filing under 35 U.S.C. 371 of International Application No. PCT/KR2016/000452, filed on Jan. 15, 2016, which claims the benefit of earlier filing date and right of priority to Korean Application No. 10-2015-0097906, filed on Jul. 9, 2015, the contents of which are all hereby incorporated by reference herein in their entirety.

TECHNICAL FIELD

The present invention relates to a wearable smart device, and more particularly, to a smart watch that may be worn on a wrist of a user, and a method for controlling the same.

BACKGROUND ART

Terminals may be generally classified as mobile/portable terminals or stationary terminals according to their mobility. Mobile terminals may also be classified as handheld terminals or vehicle mounted terminals according to whether or not a user can directly carry the terminal.

Mobile terminals have become increasingly more functional. Examples of such functions include data and voice communications, capturing images and video via a camera, recording audio, playing music files via a speaker system, and displaying images and video on a display. Some mobile terminals include additional functionality which supports game playing, while other terminals are configured as multimedia players. More recently, mobile terminals have been configured to receive broadcast and multicast signals which permit viewing of content such as videos and television programs. To perform such functions, the mobile terminal may basically be connected to other devices or network by using various communication protocols, and may provide ubiquitous computing to users. That is, the mobile terminal evolves to a smart device that enables connectivity to a network and ubiquitous computing.

Such a smart device as a mobile terminal has been manufactured at a handheld size. The user can carry it with hand or put it in a bag or pocket. However, in accordance with the development of technology, the smart device has been manufactured at a smaller size and then developed as a wearable smart device directly worn on a body of a user. Particularly, among such wearable smart devices, a smart watch worn on a wrist of a user in the form of a watch has been recently developed and widely used.

The smart watch has been developed to have typical functions of a watch at a wearable small size, for example, to have various and improved functions as mobile terminal as well as to provide time information. Moreover, a smart watch recently developed may provide multimedia functions as well as communication function and personal information management. However, as all devices are digitalized, users tend to think that analog devices are more valuable. Therefore, users prefer to a typical analog watch in spite of various and convenient functions of a smart watch. In more detail, the users prefer to actual hands, that is, a physical hour hand and a physical minute hand instead of virtual hands displayed electronically on a display unit. For this reason, to satisfy users' recent demand, a smart watch needs to provide various functions as a mobile terminal based on a display as described above while displaying the time using physical hands. Moreover, it is required to provide an optimized control method to more efficiently use physical hands and a screen of a display unit.

DISCLOSURE

Technical Problem

The present invention is intended to solve the aforementioned problems and other problems. An object of the present invention is to provide a smart watch that provides a user with physical hands and a screen of a display unit.

Another object of the present invention is to provide a method for controlling a smart watch, in which physical hands and a screen of a display unit are used together.

Technical Solution

To achieve the above or other objects, according to one aspect of the present invention, a smart watch comprises a case; at least one hand arranged to adjoin an inner circumference of the case, displaying a current time; a movement located inside the case and configured to move the hand along the inner circumference of the case; and a display unit located in the case and configured to display various kinds of information, wherein the hand and a screen of the display unit are simultaneously seen to a user.

The hand may be arranged on an outer circumference of the display unit. The hand may also be extended from the inner circumference of the case to a center of the case. Also, the hand may be configured to indicate an index displayed on a bezel installed in the case to display the current time. The hand may include a single hand simultaneously indicating hour and minute, or a hour hand and a minute hand, which respectively indicate hour and minute.

The movement may be configured to use mechanical energy or configured use a power source separately from the display unit. If the movement uses a power source, the smart watch may further comprise a first battery configured to supply a power source to the display unit and related components, and a second battery configured to supply a power source to the movement. Also, the smart watch may further comprise a crown operably connected with the movement and configured to control the hand.

The display unit may be arranged to cover the hand, and may be comprised of a transparent display. Also, the display unit may be configured to control its transparency. In more detail, to control transparency, the display unit may be configured to display a dark background screen and thus becomes opaque, or the smart watch may further comprise a dispersion panel arranged between the display unit and the hand and configured to scatter incident light to become opaque or have reduced transparency.

The hand may selectively be seen to the user, and any one of the hand and the screen of the display unit may selectively be seen to the user. In more detail, the display unit may have reduced transparency or become opaque so that the hand is not seen to the user. The display unit may display, for the user, a screen according to a predetermined operation performed when the display unit has reduced transparency or becomes opaque. Also, the display unit may have partially reduced transparency or partially become opaque so that additional function provided from the movement is seen to the user. Meanwhile, the display unit may maintain a transparent state so that the hand is seen to the user. In more detail, the display unit may be powered off to maintain a transparent state or display a screen according to a predetermined operation while maintaining a transparent state.

The display unit may be configured to further display an auxiliary hand aligned with the hand to indicate the same current time as the hand. Also, the display unit may be configured to display the amount of a battery as soon as it is powered on. Moreover, the display unit may display the time related to a predetermined operation additionally to the timed displayed by the hand. The time related to the operation may include the time when the predetermined operation will be performed or the time when the predetermined operation has been performed. In more detail, the display unit may display a marker or indicator indicating an index displayed on a bezel installed in the case to display the time related to the operation. Also, the display unit may display an image for highlighting the hand if the time related to the operation approaches. Meanwhile, in the smart watch, the time related to the operation may be set prior to display of the time related to the operation. In more detail, the time related to the operation may be set by swiping the display unit toward an index of a corresponding time displayed on the bezel installed in the case or dragging an object on the display unit to the index of the corresponding time.

Meanwhile, according to another aspect of the present invention, in a smart watch comprising a case, at least one hand arranged to adjoin an inner circumference of the case, displaying a current time, and a display unit configured to display various kinds of information, a control method of the smart watch comprises the steps of commanding the smart watch to perform a predetermined operation; performing the operation commanded from the smart watch; and simultaneously providing a screen of the display unit and the time according to the hand, which are related to the operation performed in the step of performing the operation, to a user.

The step of simultaneously providing a screen of the display unit and the time according to the hand may include the step of further displaying an auxiliary hand aligned with the hand on the display unit to indicate the same current time as the hand. Also, the step of simultaneously providing a screen of the display unit and the time according to the hand may include the step of displaying the amount of a battery as soon as the display unit is powered on.

Moreover, the step of simultaneously providing a screen of the display unit and the time according to the hand may include the step of displaying the time related to a predetermined operation on the display unit additionally to the time indicated by the hand. The time related to the operation may include the time when the predetermined operation will be performed or the time when the predetermined operation has been performed. In more detail, the step of displaying the time may include displaying a marker or indicator indicating an index displayed on a bezel installed in the case to display the time related to the operation. Also, the step of displaying the time may include the step of displaying an image for highlighting the hand if the time related to the operation approaches.

Meanwhile, the step of simultaneously providing a screen of the display unit and the time according to the hand may further include the step of setting the time related to the operation prior to the step of displaying the time. The step of setting the time related to the operation may include swiping the display unit toward an index of a corresponding time displayed on the bezel installed in the case or dragging an object on the display unit to the index of the corresponding time.

Advantageous Effects

In the present invention, a smart watch structurally includes both a physical watch and a mobile terminal. The smart watch includes a physical watch configured optimally so as not to interfere hands of the physical watch with a screen of a display unit. Therefore, the smart watch may simultaneously provide a user with the time according to the physical hands and functions as a mobile terminal implemented through a display unit.

Also, a method for controlling a smart watch may optimally control physical hands and a screen of a display unit considering their structural characteristic. Therefore, the method may allow a user to efficiently use both functions of a physical watch and a mobile terminal of a smart watch, thereby providing easiness and convenience in use.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BEST MODE FOR CARRYING OUT THE INVENTION

Figure 1:
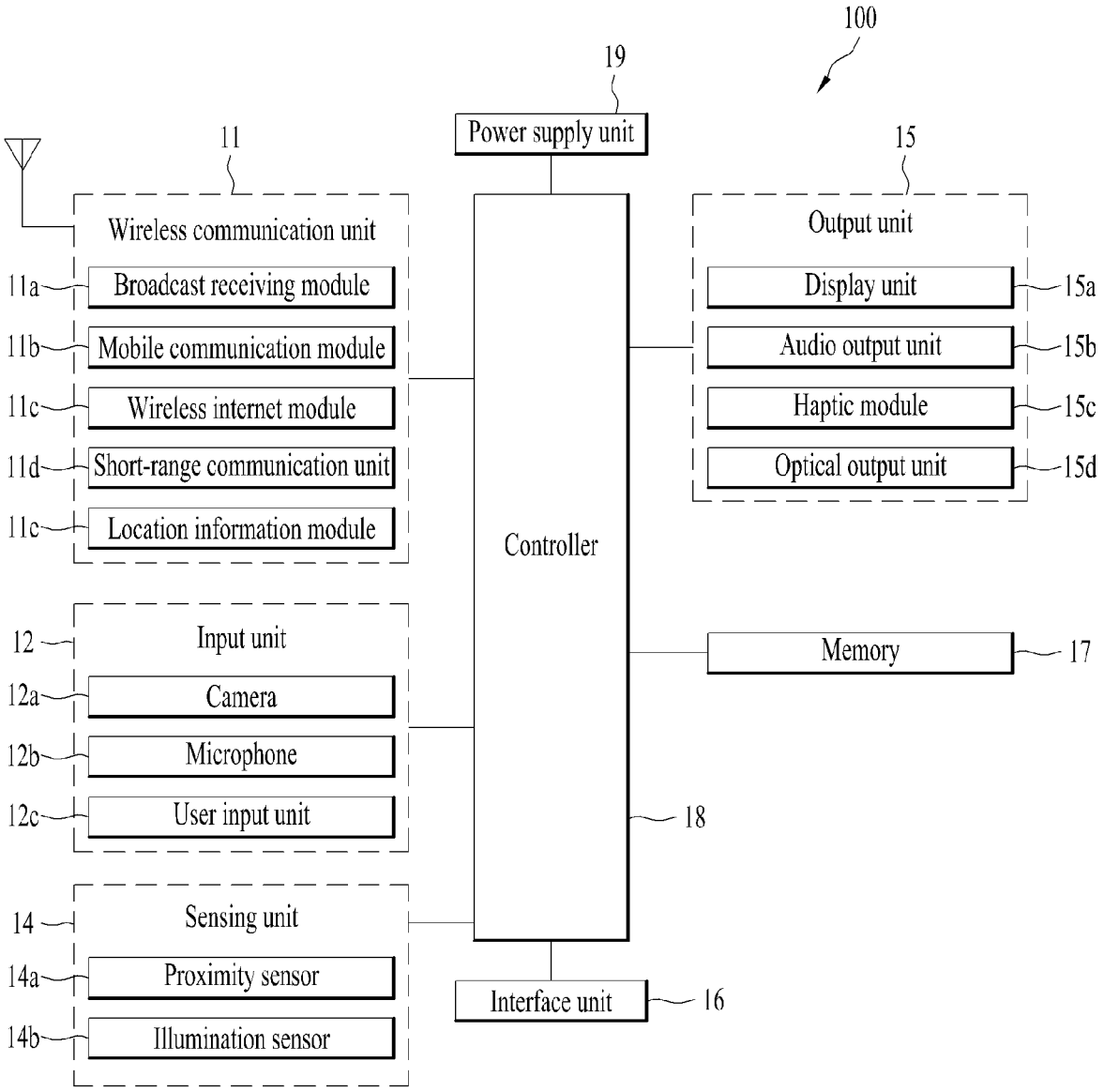
FIG. 1 is a block diagram illustrating a configuration of a smart watch described in this application.

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a term such as "module" and "unit" may be used to refer to elements or components. Use of such a term herein is merely intended to facilitate description of the specification, and the term itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first (1st), second (2nd), etc. may be used herein to describe various elements, these elements should not be limited by these terms. These terms are generally only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context.

Terms such as "comprise", "include" or "have" are used herein and should be understood that they are intended to indicate an existence of several components, functions or steps, disclosed in the specification, and it is also understood that greater or fewer components, functions, or steps may likewise be utilized. Moreover, due to the same reasons, it is also understood that the present application includes a combination of features, numerals, steps, operations, components, parts and the like partially omitted from the related or involved features, numerals, steps, operations, components and parts described using the aforementioned terms unless deviating from the intentions of the disclosed original invention.

Smart devices presented herein may be implemented using a variety of different types of terminals. Examples of such terminals include cellular phones, smart phones, laptop computers, digital broadcast terminals, personal digital assistants (PDAs), portable multimedia players (PMPs), navigators, slate PCs, tablet PCs, ultrabooks, wearable devices (for example, smart watches, smart glasses, head mounted displays (HMDs)), and the like.

By way of non-limiting example only, further description will be made with reference to particular types of smart devices. However, such teachings apply equally to other types of smart devices, such as those types noted above.

FIG. 1 is a block diagram to describe a smart watch related to the present application. A general configuration of the smart watch is described with reference to FIG. 1 as follows.

First of all, the smart watch 100 may include components such as a wireless communication unit 11, an input unit 12, a sensing unit 14, an output unit 15, an interface unit 16, a memory 17, a controller 18, a power supply unit 19, and the like. It is appreciated that implementing all of the components shown in FIG. 1 is not a requirement, and that greater or fewer components may alternatively be implemented. Moreover, the real shapes and structures of the aforementioned components are not illustrated all but the shapes and structures of some significant components are shown in the drawings following FIG. 1. Yet, it is apparent to those skilled in the art that components described without being illustrated can be included in the smart watch to embody the functions of a smart device.

In particular, among the above-listed components, the wireless communication unit 11 typically includes one or more modules which permit communications such as wireless communications between the smart watch 100 and a wireless communication system, communications between the smart watch 100 and another smart watch, communications between the smart watch 100 and an external server. Further, the wireless communication unit 11 typically includes one or more modules which connect the smart watch 100 to one or more networks.

To facilitate such communications, the wireless communication unit 11 may include one or more of a broadcast receiving module 11*a*, a mobile communication module 11*b*, a wireless Internet module 11*c*, a short-range communication module 11*d*, and a location information module 11*e*.

The input unit 12 includes a camera 12*a* (or an image input unit) for an image or video signal input, a microphone 12*b* (or an audio input unit) for an audio signal input, and a user input unit 12*c* (e.g., a touch key, a push key, etc.) for receiving an input of information from a user. Audio or image data collected by the input unit 12*c* may be analyzed and processed into user's control command.

The sensing unit 14 is typically implemented using one or more sensors configured to sense internal information of the smart watch, the surrounding environment of the smart watch, user information, and the like. For example, the sensing unit 14 may include a proximity sensor 14*a* and an illumination sensor 14*b*. If desired, the sensing unit 14 may alternatively or additionally include other types of sensors or devices, such as a touch sensor, an acceleration sensor, a magnetic sensor, a gravity sensor (G-sensor), a gyroscope sensor, a motion sensor, an RGB sensor, an infrared (IR) sensor, a finger scan sensor, a ultrasonic sensor, an optical sensor (for example, the camera 12*a*), the microphone 12*b*, a battery gauge, an environment sensor (for example, a barometer, a hygrometer, a thermometer, a radiation detection sensor, a thermal sensor, and a gas sensor, among others), and a chemical sensor (for example, an electronic nose, a health care sensor, a biometric sensor, and the like), to name a few. The smart watch 100 disclosed in the present specification may be configured to utilize information obtained from the sensing unit 14, and in particular, information obtained from one or more sensors of the sensing unit 14, and combinations thereof.

The output unit 15 is typically configured to output various types of information, such as audio, video, tactile output, and the like. The output unit 15 may include a display unit 15*a*, an audio output unit 15*b*, a haptic module 15*c*, and an optical output module 15*d*. The display unit 15*a* may have an inter-layered structure or an integrated structure with a touch sensor in order to facilitate a touchscreen. The touchscreen may provide an output interface between the smart watch 100 and a user, as well as function as the user input unit 12*c* which provides an input interface between the smart watch 100 and the user.

The interface unit 16 serves as an interface with various types of external devices that can be coupled to the smart watch 100. The interface unit 16, for example, may include any of wired or wireless ports, external power supply ports, wired or wireless data ports, memory card ports, ports for connecting a device having an identification module, audio input/output (I/O) ports, video I/O ports, earphone ports, and the like. In some cases, the smart watch 100 may perform assorted control functions associated with a connected external device, in response to the external device being connected to the interface unit 16.

The memory 17 is typically implemented to store data to support various functions or features of the smart watch 100. For instance, the memory 170 may be configured to store application programs (or applications) run in the smart watch 100, data or instructions for operations of the smart watch 100, and the like. Some of these application programs may be downloaded from an external server via wireless communication. Other application programs may be installed on the smart watch 100 at time of manufacturing or shipping, which is typically the case for basic functions of the smart watch 100 (for example, receiving a call, placing a call, receiving a message, sending a message, and the like). It is common for application programs to be stored in the memory 17, installed on the smart watch 100, and launched by the controller 18 to perform operations (or functions) for the smart watch 100.

The controller 18 typically functions to control overall operations of the smart watch 100, in addition to the operations associated with the application programs. The controller 18 may provide or process information or functions appropriate for a user by processing signals, data, information and the like, which are inputted or outputted by the various components depicted in the above description, or running application programs stored in the memory 17.

Moreover, in order to launch an application program stored in the memory 17, the controller 18 can control at least one portion of the components described with reference to FIG. 1. Furthermore, the controller 18 controls at least two of the components included in the smart watch 100 to be activated in combination to launch the application program.

The power supply unit 19 can be configured to receive external power or provide internal power in order to supply appropriate power required for operating elements and components included in the smart watch 100. The power supply unit 19 may include a battery 19*a*. In particular, the battery 19*a* may include at least one of a built-in battery or a replaceable (or detachable) battery.

At least a part of the aforementioned components may be operated in cooperation with one another to implement operation, control or control method of the smart watch 100 according to various embodiments which will be described below. Also, the operation, control or control method of the smart watch 100 may be implemented on the smart watch by driving of at least one application program stored in the memory 17.

In the following drawings, the smart watch 100 has a wearable type to be worn on a body of a user, especially a wrist of a user, that is, a type watch type. However, the present invention is not limited to this type, and may have various structures, for example, necklace type. That is, a configuration of a specific type of the smart watch 100 and its description may generally be applied to another type smart watch 100 as well as a special type smart watch 100.

Figure 2:
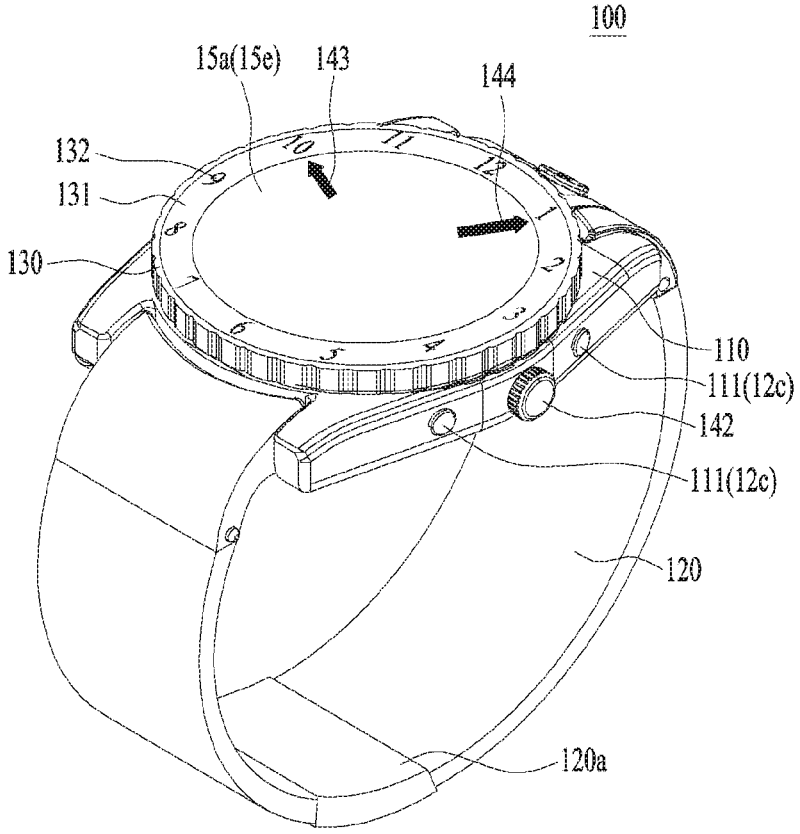
FIG. 2 is a perspective view illustrating a smart watch according to one example of this application.
Figure 3:
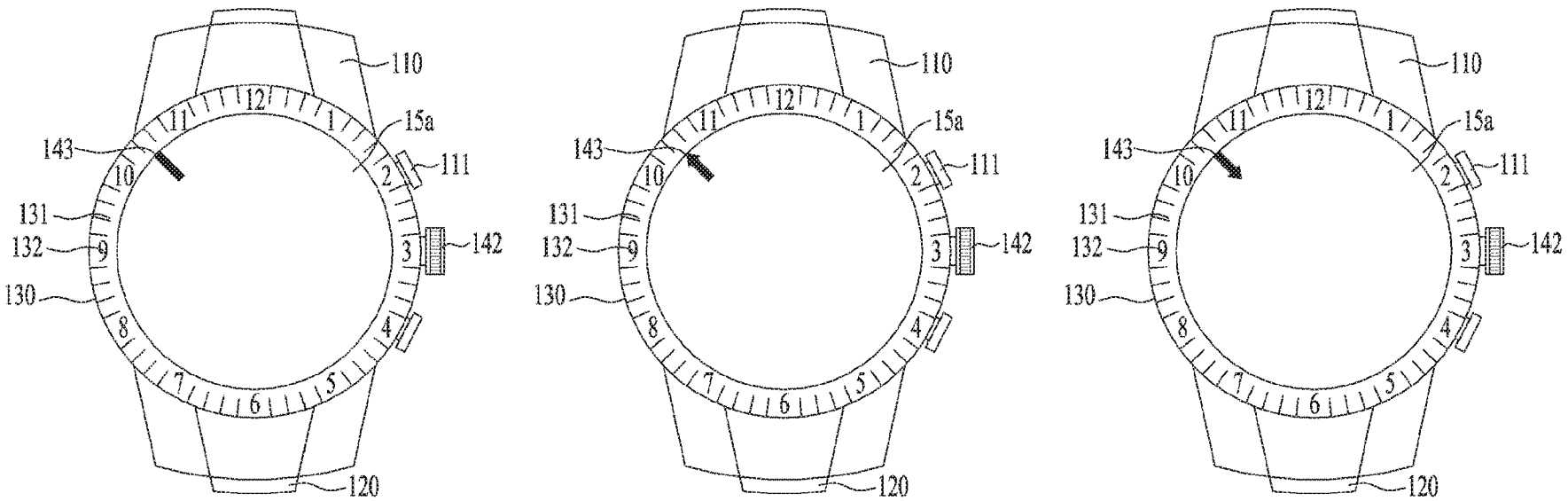
FIG. 3 is a front view illustrating examples of a single physical hand in a smart watch.
Figure 4:
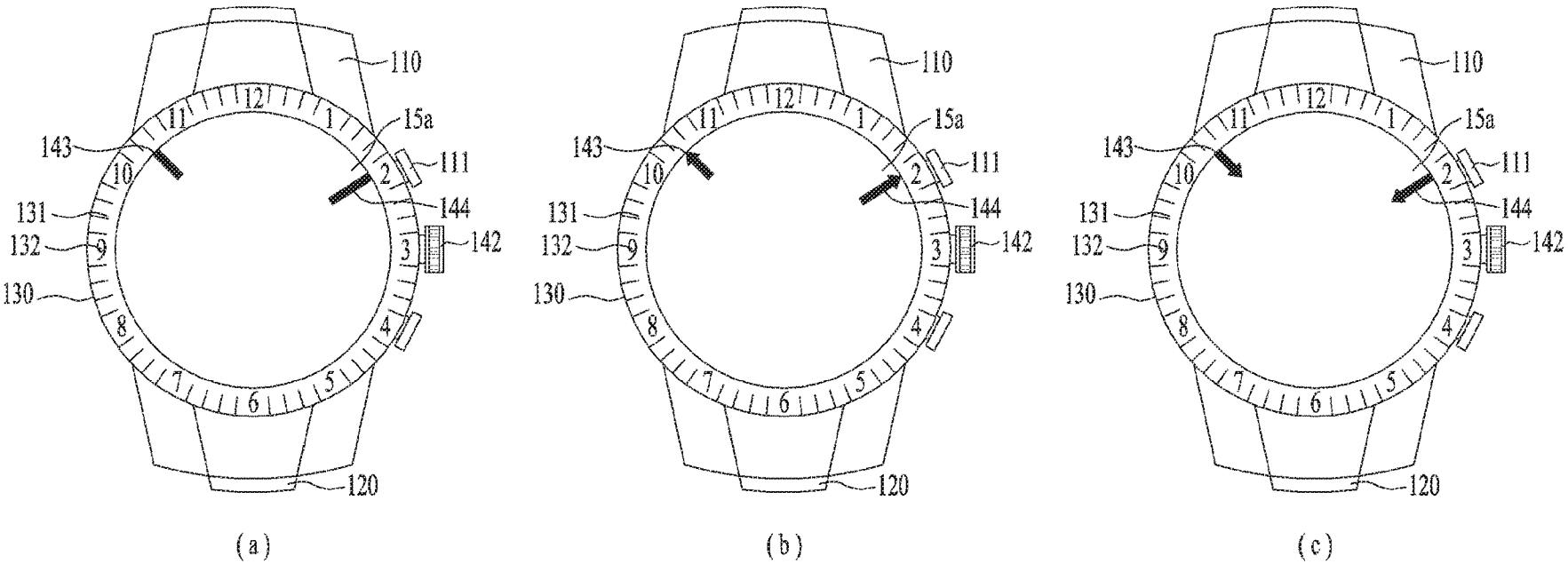
FIG. 4 is a front view illustrating examples of a plurality of physical hands in a smart watch.

Subsequent to the general configuration of the aforementioned smart watch 100, a structure of the smart watch 100 will be described with reference to the related drawings. In this respect, FIG. 2 is a perspective view illustrating a smart watch according to one example of this application, FIG. 3 is a front view illustrating examples of a single physical hand in a smart watch, FIG. 4 is a front view illustrating examples of a plurality of physical hands in a smart watch, and FIGS. 5 to 8 are cross-sectional views illustrating a smart watch. Since FIG. 2 illustrates an entire structure of the smart watch 100, all descriptions will basically be understood with reference to FIG. 2 except that referring drawings are especially mentioned.

The smart watch 100 may include a case 110 substantially forming a body of the smart watch 100. The case 110 may form an inner space of a predetermined size to receive various components therein as shown in FIGS. 5 to 8. The case 110 may have an opening 110*a* communicated with the inner space such that the components may be installed in the inner space. The case 110 may be made of one member wholly. However, the case 110 may have a case back 110*b* detachably coupled as shown, and may easily access the internal components received through the detachable case back 110*b*. Also, the shown case 110 may generally have a circle shape, but may have various shapes including a rectangular shape.

The smart watch 100 may include a band 120 connected to the case 100. The band 120 may be configured to allow the smart watch 100 to be worn on a body, that is, a wrist. The band 120 may be worn on a wrist to surround the wrist, and may be formed of a flexible material to be easily worn the wrist. As such an example, the band 120 may be formed of leather, rubber, silicon, synthetic material, or the like. Also, the band 120 may be configured to be detachable in the case 110, may be exchanged with various shaped bands in accordance with a user's preference. Meanwhile, the band 120 may be used to enlarge throughput of an antenna of the wireless communication unit 11 (see FIG. 1). For example, a ground extension portion (not shown) electrically connected with the antenna, extending a ground area may be embedded in the band. Also, the band 202 may be provided with a fastener 120*a*. The fastener 120*a* may be implemented into a buckle type, a snap-fit hook structure, a Velcro™ type, or the like, and may include a flexible section or material. In FIG. 2, the fastener 120*a* is implemented in a type of a buckle.

The smart watch 100 may include a bezel 130 arranged on the case 110. The bezel 130 is made of a ring shaped member, and may be extended along the edge of the case 110. In more detail, the bezel 130 may be configured to surround the opening 110*a* of the case 110. Therefore, as described later, the bezel 130 may surround the display unit 15*a* arranged in the opening 110*a* and thus protect the display unit 15*a*. Moreover, the bezel 130 may hold a separate glass or crystal member, which protects the display unit 15*a*, or hold the display unit 15*a*. In addition to protective purpose, the bezel 130 may be configured to provide other functions, and may be used for ornamental purpose.

As described above, the case 110 may basically be configured to support various electronic and mechanical components required for an operation of the smart watch 100 in view of function aspect. Since FIGS. 5 to 8 illustrate the inside of the smart watch 100 well, internal components of the smart watch will be described with reference to these drawings.

The smart watch 100 may include the display unit 15*a* as the output unit 15. The display unit 15*a* may be exposed from the watch 100 to allow the user to well see the display unit 15*a* in a state that the user wears the smart watch 100. The display unit 15*a* may basically be arranged in the case 110, and may be exposed to the user through the opening 110*a* of the case 110. Therefore, the display unit 15*a* may form an external appearance of the smart watch 100 together with the case 100. Also, the display unit 15*a* may provide various kinds of information to the user as functions of the mobile terminal or the smart device. In more detail, the display unit 15*a* may display information processed by the smart watch 100. For example, the display unit 15*a* may basically output various kinds of images and text information, and may display execution screen information of an application program driven by the smart watch 100 or a user interface (UI) and a graphic user interface (GUI) according to the execution screen information. Moreover, the display unit 15*a* may notify the user of the current time. To display the current time, the display unit 15*a* may directly display a number corresponding to the current time and display dial or face and hands like an analog watch. That is, the display unit 15*a* and other electronic components related to the display unit 15*a* may implement an electronic and virtual watch in the smart watch.

Figure 5:
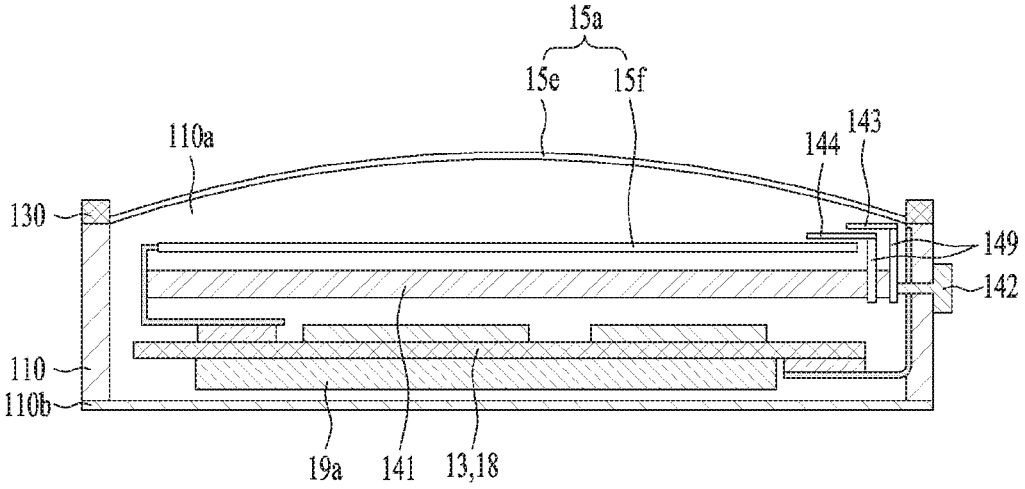
FIGS. 5 to 8 are cross-sectional views illustrating a smart watch.
Figure 6:
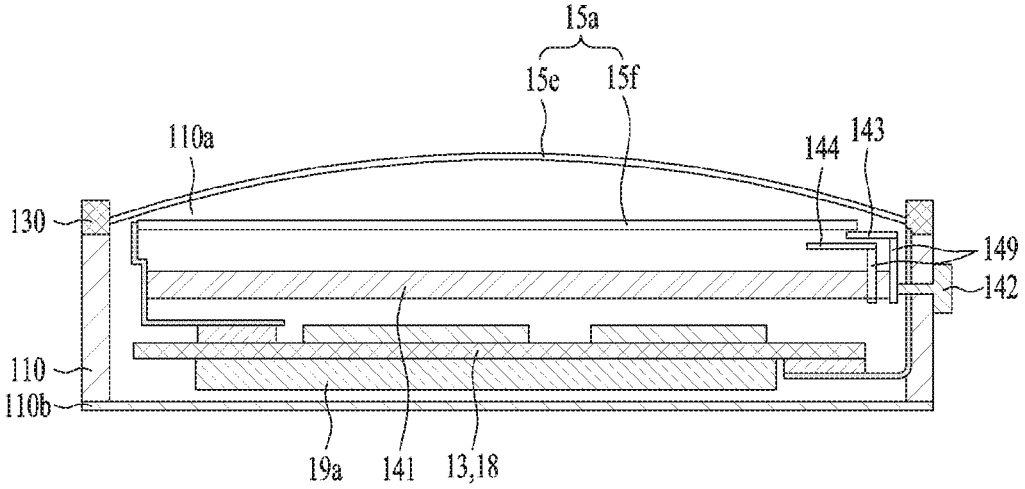
Figure 7:
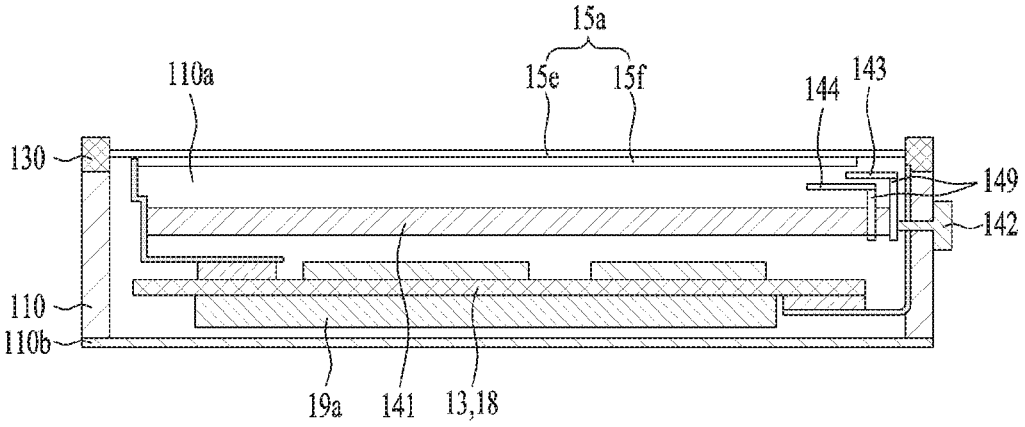
Figure 8:
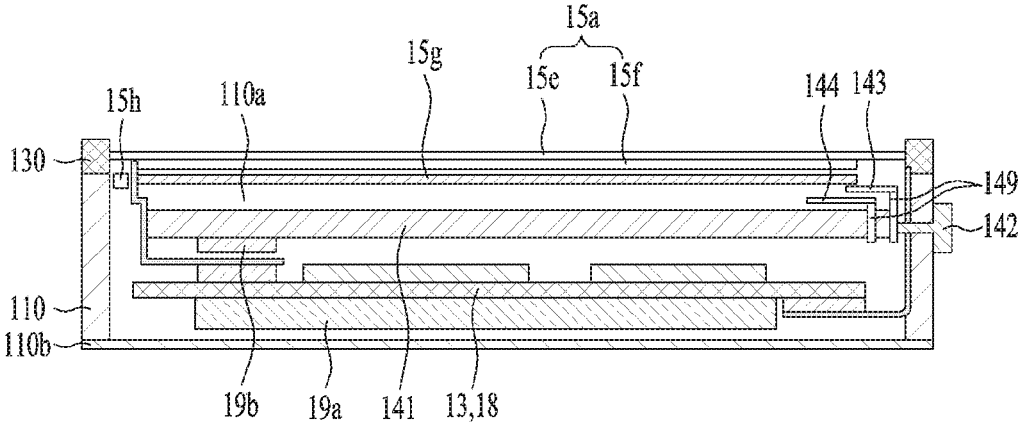

The display unit 15*a* may include at least one of a liquid crystal display (LCD), a thin film transistor-liquid crystal display (TFT-LCD), an organic light-emitting diode (OLED), a flexible display, a 3D display, and an e-ink display. The display unit 15*a* may include a display module 15*f* and a window 15*e* that covers the display module 15*f*. The display module 15*f* may be comprised of a display element such as LCD and OLED as described above, and is an element substantially displaying image information. The window 15*e* may be arranged in a portion exposed to the user of the display module 15*f*, and may protect the display module 15*f* from the outside. That is, the window 15*e* may function as a glass or crystal member in a typical watch. In addition to this protective function, the window 15*e* should allow the user to see information displayed on the display module 15*f*. Therefore, the window 15*e* may be made of a material having proper strength and transparency. As shown in FIGS. 5 and 6, the window 15*e* may be detached from the display module 15*f*. In this case, as shown, the bezel 130 may be configured to hold the window 15*e*. Meanwhile, as shown in FIGS. 7 and 8, the display module 15*f* may directly be attached to a rear surface of the window 15*e*. In this case, as shown, the bezel 130 may be configured to hold both the window 15*e* and the display module 15*f*. The display module 15*f* may directly be attached to the window 15*e* in various methods, and an adhesive may be used most conveniently for direct attachment.

The display unit 15*a* may include a touch sensor for sensing a touch for the display unit 15*a* to receive a control command by means of a touch mode. If the touch for the display unit 15*a* is made using this touch sensor, the touch sensor may sense the touch and the controller 18 may generate a control command corresponding to the touch on the basis of the touch. A content input by the touch mode may be text or number, or may be a menu item that may be indicated or designated in various modes. The touch sensor may be configured in a film type having a touch pattern and arranged between the window 15*e* and the display module 15*f*, or may be a metal wire directly patterned on the rear surface of the window 15*e*. As shown in FIGS. 5 and 6, if the window 15*e* is detached from the display module 15*f*, the touch sensor may be formed in a single body with the window 15*e*. Alternatively, the touch sensor may be formed in a single body with the display module 15*f*. For example, the touch sensor may be arranged on a substrate of the display module 15*f*, or may be provided inside the display module 15*e*. The touch sensor formed in a single body with the display module 15*f* may be applied to the display module 15*f* attached to the window 15*e* as shown in FIGS. 7 and 8. In this way, the display unit 15*a* may form a touch screen together with the touch sensor. In this case, the touch screen may function as a user input unit 12*c* (see FIG. 1). If necessary, a physical key (for example, push key) may additionally be provided for a convenient input of the user as the user input unit 12*c* to adjoin the display unit 15*a* which is a touch screen.

The substrate 13 is an element on which various electronic components, especially various processors constituting the controller 18 are mounted together with other circuits and elements for assisting the processors, and may be installed in the case 110. Although not shown in detail, the respective components 11 to 19 shown in FIG. 1 may directly be installed in the substrate 13 to be controlled by the controller 18, or may be installed in the case 110 and electrically connected to the substrate 13. For example, as shown in FIGS. 5 to 8, each of the window 15*e* (that is, touch sensor) and the display module 15*f* may be connected to the substrate 13 through a line. Therefore, the substrate 13 and the controller 18 may control an operation of the smart watch 100, more specifically all components of the smart watch 100.

Moreover, the smart watch 100 may include a battery 19*a* (see FIG. 1) as a power supply unit 19 for power supply. The battery 19*a* may be fixed into the case 110 or may detachably be installed in the case 110. The battery 19*a* may be charged through a power cable connected to the smart watch 100. Also, the battery 19*a* may be configured to enable wireless charge through a wireless charging device. The wireless charge may be implemented by a magnetic induction mode or resonance mode (magnetic resonance mode).

In addition to a digital device provided by the above-described various electronic components, that is, the mobile terminal or the smart device, the smart watch 100 may further include a watch as an analog device. That is, the smart watch 100 may be configured to substantially display the current time by using physical hands. This time display may be performed by a physical watch unit.

The smart watch 100 may include a movement 141 as the physical watch unit. The movement 141 may be located in the case 110 as shown in FIGS. 5 to 8. The movement 141 may be configured to move physical hands 143 and 144, which will be described later, to display the current time. In more detail, the movement 141 may comprise a plurality of small components such as gear and springs to move the hands 143 and 144 connected thereto, wherein these components are received in a separate housing. That is, the movement 141 may be installed in the case 110 as a module.

The smart watch 100 may include at least one hand 143 as the physical watch unit. The hand 143 may be comprised of a physical member, specifically a needle shaped member. That is, the hand 143 is comprised of a physical hand having a substantial body not a virtual hand. As known, the hand is arranged at the center of the case 110 in a typical analog watch. However, as shown in FIGS. 3 and 4 as well as FIG. 2, the hand 143 may be arranged to be spaced apart from the center of the case 110 in the smart watch 100. In more detail, the hand 143 may be arranged to adjoin an inner surface or inner circumference of the case 110. The inner circumference of the case 110 forms the opening 11*a* as described above. The display unit 151 is inserted into the case 110 through the opening 110*a*, and may have a size approximately corresponding to the size of the opening 110*a* to be sufficiently exposed to the user. Therefore, the hand 143 may be arranged to the inner circumference of the case 110 as shown, whereby the hand 143 may be arranged at the outer circumference of the display unit 15*a*, specifically at an end of the display unit 15*a*. Moreover, since the bezel 130 surrounds the opening 110*a* or the 15*a*, the hand 143 may be arranged to adjoin the inner circumference of the bezel 130. Also, in a typical analog watch, the hand is extended from the center of the case 110 to the outside of a radius direction. However, the hand 143 may be extended toward the center of the case 110 from the inner circumference of the case 110 due to arrangement adjacent to the inner circumference of the case 110. That is, the hand 143 may be extended from the inner circumference of the case 110 to the inside of the radius direction of the case 110.

The hand 143 may display the current time for the user by indicating text or scale in the same manner as the typical analog watch. In the typical analog watch, a dial or watch face is installed at the center of the case 110, that is, the opening 110*a*, and includes indexes such as text, number, and scale. However, since the hand 143 is arranged at the inner circumference of the case 110, instead of the typical dial or face, the bezel 130 adjacent to the hand 143 may be used to display the time. In more detail, the bezel 130 may have a dial 131 arranged thereon as shown in FIGS. 2 to 4. The dial 131 may have a ring shape in accordance with a shape of the bezel 130. The indexes 132 may be displayed in due order along the dial 131. Therefore, the hand 143 may display the current time by indicating the indexes 132 of the bezel 130.

Also, as shown in FIG. 3, the smart watch 100 may include a single physical hand 143 to display the current time. The single hand 143 may be configured to simply indicate the time only without displaying a minute. However, the single hand 143 may be configured to indicate hour and minute at the same time. In more detail, as shown in FIG. 3, an interval between indexes for displaying one hour may be divided into a plurality of scales, and the single hand 143 may indicate minute together with hour while moving from one index to another adjacent index. For example, if a portion between indexes "1" and "2' is divided into 12 scales, one scale may indicate a time interval of 5 minutes between 1 o'clock and 2 o'clock. Therefore, the single hand 143 may indicate 1 o'clock corresponding to hour and a corresponding minute at the same time while gradually moving from index "1" to index "2". Also, as shown in the other drawings (especially, FIG. 4) except FIG. 3, the smart watch 100 may include a plurality of hands 143 and 144. The plurality of hands 143 and 144 may be an hour hand and a minute hand, respectively, which indicate hour and minute. Particularly, the minute hand 144 of the hands may be formed to be longer than the hour hand 143 to be identified from the hour hand 143. However, except this length difference, the minute hand 144 is the same as the hour hand 143 in the aforementioned characteristics, for example, arrangement and extension direction. Meanwhile, as shown in FIG. 3(*a*), the single hand 143 may have a simple bar shape. Also, as shown in FIG. 3(*b*), the signal hand 143 may include an arrow at an end adjacent to the inner circumference of the case 110 or the bezel 130 to allow the user to more easily recognize the indicated time. Meanwhile, as shown in FIG. 3(*c*), the single hand 143 may include an arrow at an end adjacent to the center of the case 110 to face the hand of FIG. 3(*b*). Likewise, the plurality of hands 143 and 144 may have a simple bar shape as shown in FIG. 4(*a*), or may include an arrow at an end adjacent to the inner circumference of the case 110 or the bezel 130 as shown in FIG. 4(*b*) or an arrow at an end adjacent to the center of the case 110 as shown in FIG. 4(*c*). Also, the smart watch 100 may further include a second hand, which indicates second, in addition to the hour hand 143 and the minute hand 144. This second hand may have the same structural characteristics as those of the above-described hour hand 143 and minute hand 144.

The hands 143 and 144 may mechanically be connected with the movement 141 for movement as shown in FIGS. 5 to 8. For example, the hands 143 and 144 may be connected with internal mechanical components of the movement 141 by using a connection member 149 such as a shaft or rod. The movement 141 may gradually move the hands 143 and 144 along the inner circumference of the case 110 or the bezel 130, whereby the hands 143 and 144 may indicate the corresponding index 132 of the bezel 130 to exactly display the current time. In more detail, the hands 143 and 144 revolves with respect to the center of the case 110 along the inner circumference of the bezel 130 or the case 110 to display the current time due to arrangement of the case 110 or the bezel 130 adjacent to the inner circumference. For such a revolving movement, the movement 141 may use various mechanical mechanisms. For example, an epicyclic gear system may be adopted. Meanwhile, the hands 143 and 144 need to be controlled by the user for correction of a time error or other purpose. Therefore, the smart watch 100 may include a crown 142 as a part of the physical watch unit. The crown 142 is located at a side of the case 110, and is operably connected to the movement 141 through the case 110. In more detail, the crown 142 may be rotatably connected to the movement 141, and may be rotated to move the hands 143 and 144. Therefore, as the crown 142 may be used, the hands 143 and 144 may be controlled to indicate the exact time. Moreover, since the crown 142 is directly connected to the movement 141 to control the hands 143 and 144, the crown 142 cannot be used to control the operation of the other electronic components. For this reason, the smart watch 100 may include a push button 111 as an input unit 12*c* (see FIG. 1). The push button 111 may be arranged at a side of the case 110 to adjoin the crown 142 as shown in FIG. 2. As an example, the push button 111 may be installed in the substrate 13 or adjoin a switch electrically connected to the substrate 13. Therefore, as the push button 111 is pushed, a predetermined electric signal is given to the substrate 13 and the controller 18, whereby functions as the mobile terminal may be instructed to the corresponding electronic components.

The movement 141 may also be operated in various manners to move the hands 143 and 144. For example, the movement 141 may be classified into a mechanical movement and a quartz movement. The mechanical movement may drive the internal components and the hands 143 and 144 by using mechanical energy only stored in a spring. The crown 142 may be rotated to wind the spring, whereas the spring may be wound automatically by movement of the user. Also, mechanical components are basically used for the electronic movement but the electronic movement needs a battery to supply a power source to a quartz and a stepping motor, which drive the mechanical components. If the movement 141 is comprised of a quartz movement, the movement 141 may share the battery 19*a* with the electronic components of the smart watch 100. However, since the display unit 15*a* and the other electronic components need a considerable amount of power sources, the smart watch 100 cannot be operated by the single battery 19*a* for a sufficient time. As a result, if the electronic components and the physical watch unit use the same battery 19*a*, the electronic device of the smart watch 100 and the physical watch cannot be operated for a sufficient time. However, since the quartz movement 141 uses a small amount of power source, the quartz movement 141 can be operated for several months to several years even in the case that a typical battery is used. Also, the mechanical movement 141 may be supplied with mechanical energy by winding a spring. Therefore, the movement 141 is preferably configured to use mechanical energy, that is, is comprised of a mechanical movement, or is configured to use a power source different from those of the display unit 15*a* and the other electronic components if it is comprised of a quartz movement. In accordance with this configuration, the physical watch unit may continuously display the time for the user even in the case that the operation of the electronic components is stopped due to too low battery power. That is, the smart watch 100 may always act as at least an analog watch. If the movement 141 uses a battery power different from that of the display unit 15*a* or the other electronic components, as shown in FIG. 8, the smart watch 100 may include a first battery 19*a* configured to supply a power source to the display unit 15*a* and the electronic components and a second battery 19*b* provided separately from the first battery 19*a* and configured to supply a power source to the movement 141.

As described above, the smart watch 100 may include an electronic device, which provides functions as a mobile terminal, and the physical watch unit for displaying the time in an analog type, thereby allowing the user to simultaneously see the physical hands 143 and 144 and the screen of the display unit 15*a* during operation. That is, the smart watch 100 may allow the user to simultaneously see the hands 143 and 144 arranged to display the current time and the screen of the display unit 15*a* for displaying a predetermined function currently executed in the smart watch 100. In this case, since the hands 143 and 144 already display the current time, the display unit 15*a* may display a screen for performing a function different from a display of the current time. Also, since the physical hands 143 and 144 are arranged to adjoin the inner circumference of the case 110 or the bezel 130, the physical hands 143 and 144 do not interfere with the screen of the display unit 15*a* substantially. Therefore, the smart watch 100 may provide the current time substantially and effectively by using the physical hands 143 and 144 while providing various functions and operations as the mobile terminal through the screen of the display unit 15*a*. That is, the smart watch 100 may substantially be operated as the analog watch and the mobile terminal by optimally arranging the hands 143 and 144 of the physical watch unit.

To simultaneously display the screen and the hands for the user, as shown in FIG. 5, the display unit 15*a* may be arranged below the hands 143 and 144. In accordance with this arrangement, the hands 143 and 144 are arranged to be closer to eyes of the user than the display unit 15*a*. That is, the hands 143 and 144 are always exposed to eyes of the user without being covered by the display unit 15*a*. Therefore, if the display unit 15*a* outputs the screen, the screen and the hands 143 and 144 may always be seen to the user at the same time. However, if the window 15*e* is attached to the display module 15*f*, a touch of the window 15*e* to indicate the operation may interfere with the hands 143 and 144, and the hands 143 and 144 may be exposed to the outside. Therefore, as shown in FIG. 5, the display unit 15*a* is only below the hands 143 and 144, and the window 15*e* may be arranged above the hands 143 and 144 together with the touch sensor. In accordance with this final arrangement, the smart watch 100 may display the screen and the hands for the user and properly protect the hands 143 and 144 without interference of touch.

Meanwhile, the smart watch 100 may selectively display the hands 143 and 144 for the user in addition to simultaneous display the screen and the hands for the user. For this function, as shown in FIGS. 6 to 8, the display unit 15*a* may be arranged above the hands 143 and 144. In accordance with this arrangement, the display unit 15*a* may be arranged to be closer to eyes of the user than the hands 143 and 144. That is, the display unit 15*a* may be arranged to cover the hands 143 and 144, and may always be exposed to the outside of the smart watch 100. Also, since window 15*e* is exposed to the outside of the smart watch 100 in the same manner as the touch sensor, a touch for the window 15*e* does not interfere with the hands 143 and 144. Therefore, if the display unit 15*a* is arranged above the hands 143 and 144, the window 15*e* may be detached from the display unit 15*f* as shown in FIG. 6, or may be attached to the display unit 15*f* as shown in FIGS. 7 and 8. However, in this arrangement, if the display unit 15*a* is comprised of a typical opaque display unit 15*f*, the hands 143 and 144 are covered by the opaque display unit 15*a*, whereby the hands 143 and 144 are not seen to the user. On the other hand, since the display unit 15*a* of FIG. 5 is arranged below the hands 143 and 144 to always expose the hands 143 and 14, the display unit 15*a* of FIG. 5 may be comprised of a typical opaque display. Therefore, in the smart watch of FIGS. 6 to 8, the display unit 15*a* is comprised of a transparent display such that the hands 143 and 144 may be seen to the user if necessary. Since the window 15*e* of the display unit 15*a* is basically formed transparently as described above, in order that the display unit 15*a* becomes transparent on the whole, the display unit 15*f* may be comprised of a transparent display. The transparent display may be comprised of LCD (Liquid Crystal Display), OLED (Organic Light-Emitting Diode), Electro-Wetting Display, etc. These transparent displays may be classified into an emissive transparent display and a passive transparent display in accordance with an implementation mode of transparency. The transparent LCD is a main passive transparent display panel, and the transparent OLED is a main emissive transparent display panel. Since the principles of these transparent displays are already known in the art, their description will be omitted in the following description.

Also, the display unit 15*a* may be configured to control transparency. The display unit 15*a* that covers the hands 143 and 144 may allow the hands 143 and 144 to be selectively be seen to the user by means of such a control of the transparency. For example, if the display unit 15*a* becomes opaque or has remarkably reduced transparency, the hands 143 and 144 are covered by the display unit 15*a*, and may not be seen to the user. On the other hand, if the display unit 15*a* becomes transparent, the hands 143 and 144 may be seen to the user by the transparent display unit 15*a*. Transparency of the display unit 15*a* may be performed by various methods. As the simplest method, the display unit 15*a* may control its transparency by controlling its background color. In more detail, the display unit 15*a* may display a background screen which is dark on the whole. For example, if the display unit 15*a* displays a background screen of a black color on the whole, the display unit 15*a* may become opaque substantially. On the other hand, since the display unit 15*a* is basically transparent, if the display unit 15*a* does not include a dark background color especially, the display unit 15*a* may maintain transparency while displaying a predetermined screen. Also, if the display unit 15*a* is turned off, the display unit 15*a* may continue to maintain transparency due to its basic transparency.

Figure 10:
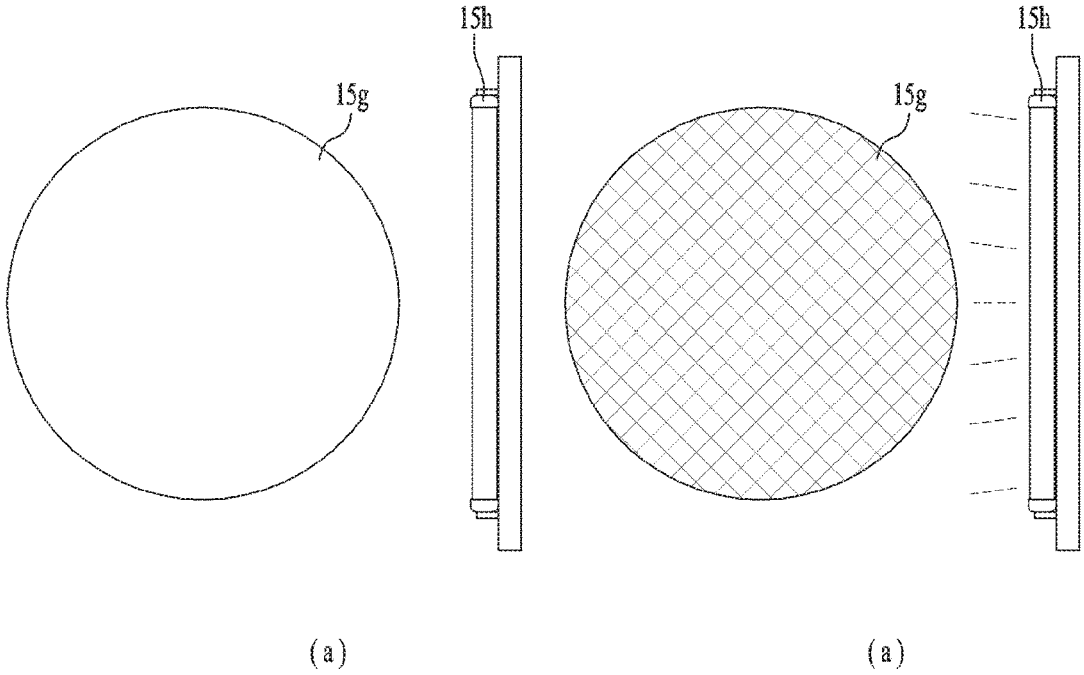
FIG. 10 is a plane view illustrating a state of a dispersion panel depending on whether a light source irradiates light.

Also, the display unit 15*a* may further include a separate mechanism to control transparency. In more detail, the smart watch 100 may further include a dispersion panel 15*g* arranged between the display unit 15*a* and the hands 143 and 144 as shown in FIG. 8. Also, the smart watch 100 may include a light source 15*h* arranged at a side of the dispersion panel 15*g*. Although not shown, a supporter may be arranged between the display unit 15*a* and the hands 143 and 144 such that the dispersion panel 15*g* and the light source 15*h* may exactly be installed at the aforementioned positions. The dispersion panel 15*g* may be configured to control its transparency depending on whether light is irradiated to its side. Likewise, transparency of the display unit 15*a* may be controlled in accordance with the control of transparency of the dispersion panel 15*g*. Also, the light source 15*h* is comprised of a lamp, and is configured to irradiate light to the side of the dispersion panel 15*g*. The light source 15*h* may be extended longitudinally along the side to uniformly irradiate light to the side of the dispersion panel 15*g* as shown in FIG. 10.

Figure 9:
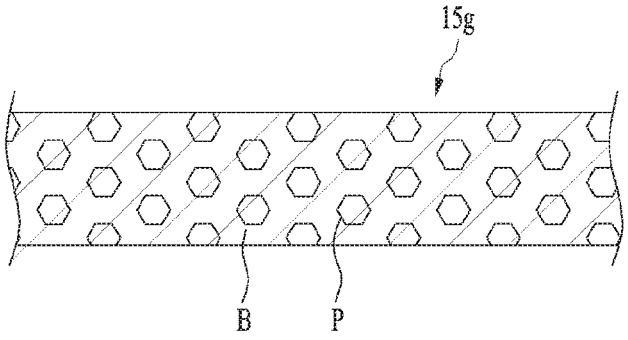
FIG. 9 is a cross-sectional view illustrating a dispersion panel installed in a smart watch.

The dispersion panel 15*g* may be configured to scatter light entering the inside through the side, thereby controlling its transparency. In more detail, the dispersion panel 15*g* may be comprised of a body B of a first material and particles P of a second material different from the first material as shown in FIG. 9. The particles P are fine particles, each of which has a diameter of several micrometers, and are included in the body B. Both the first material and the second material may basically be transparent materials. However, the first material and the second material have their respective refractive indexes different from each other. Therefore, if the light source 15*h* irradiates light to the side of the dispersion panel 15*g*, the light entering the side of the dispersion panel 15*g* may move through total reflection within the dispersion panel 15*g*. If this light meets the particles P during movement, the light may be scattered due to a refractive index of the particles P different from the body B. Therefore, as shown in FIG. 10(*b*), if light is irradiated to the side of the dispersion panel 15*g* by means of the light source 15*h*, scattering of light is not generated due to the light entering the dispersion panel 15*g*. Therefore, as shown in FIG. 10(*a*), the dispersion panel 15*g* may maintain the transparent state on the whole due to the body B and the particles P, which are comprised of the first and second transparent materials. That is, if the light source 15*h* irradiates light to the dispersion panel 15*g*, transparency of the dispersion panel 15*g* is deteriorated, or the dispersion panel 15*g* becomes opaque. If the light source 15*h* does not irradiate light to the dispersion panel 15*g*, the dispersion panel 15*g* maintains a transparent state due to its transparency. Also, transparency of the display unit 15*a* may be changed in the same manner as that of the dispersion panel 15*g*.

Figure 11:
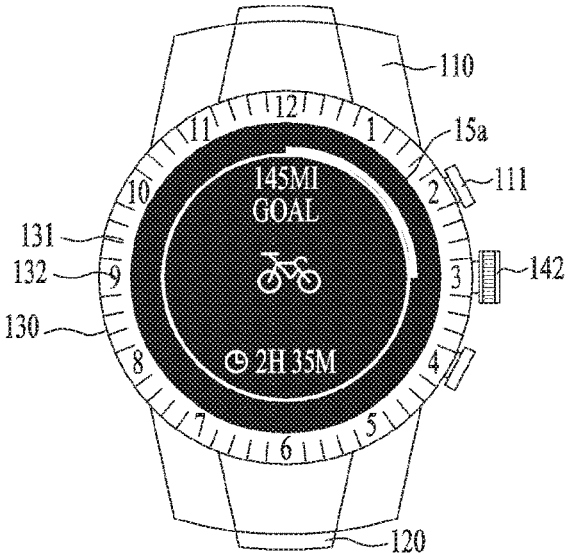
FIG. 11 is a front view illustrating a smart watch that allows a user to see only a screen of a display unit.
Figure 12:
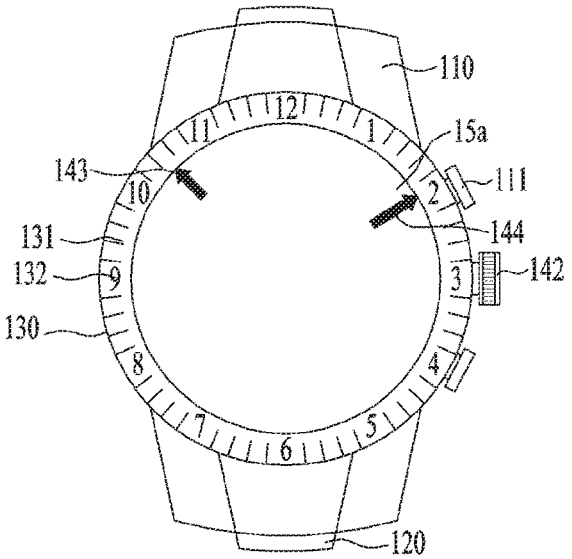
FIG. 12 is a front view illustrating a smart watch that allows a user to see only physical hands.
Figure 13:
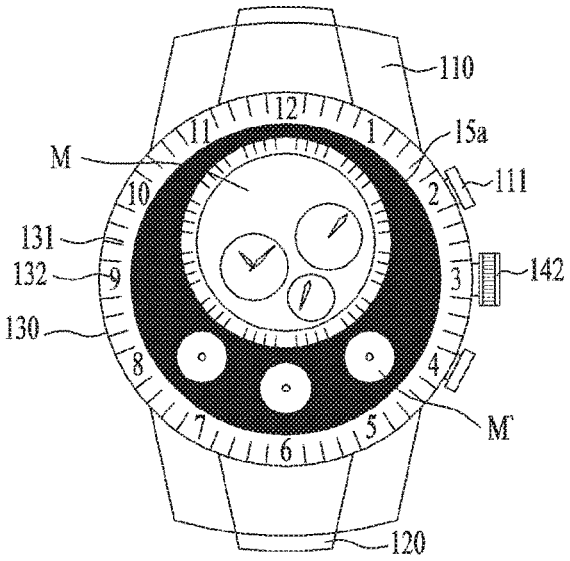
FIG. 13 is a front view illustrating a smart watch that allows a user to see additional function of a movement.
Figure 14:
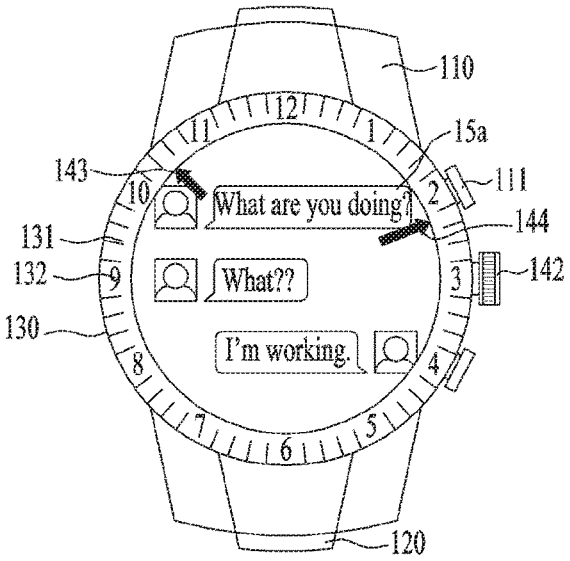
FIG. 14 is a front view illustrating a smart watch that allows a user to see both a screen of a display unit and physical hands.

The hands 143 and 144 may selectively be seen to the user in accordance with the transparency control of the display unit 15*a*. This selective display of the hands 143 and 144 may be implemented in the smart watch 100 in various modes for a convenient and useful use of the user. Next, substantial examples of the selective display of the hands will be described with reference to the related drawings. FIG. 11 is a front view illustrating a smart watch that allows a user to see only a screen of a display unit, FIG. 12 is a front view illustrating a smart watch that allows a user to see only physical hands, FIG. 13 is a front view illustrating a smart watch that allows a user to see additional function of a movement, and FIG. 14 is a front view illustrating a smart watch that allows a user to see both a screen of a display unit and physical hands.

First of all, the user may need to use the entire screen of the display unit 15*a* in accordance with various purposes or reasons. For example, when the user desire to perform a specific operation, the entire screen of the display unit 15*a* may be required to preferably perform the specific operation or function. In this case, as shown in FIG. 11, the display unit 15*a* may have reduced transparency or become opaque so that the hands 143 and 144 may not be seen to the user. For example, in order that the display unit 15*a* has reduced transparency or becomes opaque, the display unit 15*a* may display a background screen of a dark color or light may be irradiated to the dispersion panel 15*g*. Since the method for controlling transparency has been described as above, its detailed description will be omitted. Also, when the display unit 15*a* has reduced transparency or becomes opaque, the screen based on that the predetermined operation is performed may be displayed for the user. Therefore, in FIG. 11, the hands 143 and 144 are covered, and only the screen of the display unit 15*a* may be provided to the user. As a result, the user may conveniently use the entire screen of the display unit 15*a*.

Meanwhile, the movement 141 may provide various functions in addition to time display based on the hands 143 and 144. These additional functions may be referred to as complication as a horology. For example, chronograph, calendar, etc. may be included in the complication. The complication may be exposed to a surface of the movement 141, an upper surface of the movement 141 in the drawing, whereby the complication may be seen to the user in the same manner as the hands 143 and 144. When the predetermined operation is performed on the smart watch 100, the user may desire to see the complication unlike the hands 143 and 144. Also, the specific operation may need the complication, and may assist the complication in another aspect. In this case, as shown in FIG. 13, the display unit 15*a* may have reduced transparency or partially become opaque such that the complication M may be seen to the user. As shown in FIG. 13, a partial transparent portion formed relatively with respect to the partial opaque portion of the display unit 15*a* may expose the complication M, whereas the partial opaque portion may cover the hands 143 and 144 so as not to be seen to the user. Also, the display unit 15*a* may display a screen M' according to a predetermined operation performed on its partial opaque portion, for the user. This operation may need the complication M or assist the complication M as described above. Also, the relative transparent portion of the display unit 15*a* may display a screen overlapped with the complication M if necessary. Therefore, in FIG. 13, the hands 143 and 144 are covered, and the complication M and the screen M' of the display unit 15*a* may be provided to the user, whereby the user may use conveniently use the desired complication M and the function provided by the display unit 15*a*.

Also, as described above, the physical watch unit may stably notify the user of the time by means of low power consumption or mechanical power supplement. Therefore, except some special cases described above, the physical hands 143 and 144 seen to the user may be important in continuously performing time notification which is the most basic function of the smart watch 100. For this reason, the display unit 15*a* may maintain the transparent state to allow the hands 143 and 144 to be seen to the user. In more detail, if the display unit 15*a* is powered off, the display unit 15*a* may continue to maintain transparency due to its basic transparent characteristic. Therefore, as shown in FIG. 12, the display unit 15*a* may be powered off to maintain the transparent state, and only the hands 143 and 144 may be seen to the user. Meanwhile, since the display unit 15*a* is basically transparent, if the display unit 15*a* does not include an especially dark background color, the display unit 15*a* may maintain transparency while displaying a predetermined screen. Therefore, as shown in FIG. 14, the display unit 15*a* may display the screen according to the predetermined operation performed while maintaining the transparent state. For this reason, in FIG. 14, the hands 143 and 144 and the screen of the display unit 15*a* may be provided to the user at the same time. That is, the display unit 15*a* above the hands 143 and 144 of FIGS. 6 and 7 may provide the user with both the hands 143 and 144 and the screen of the display unit 15*a* in the same manner as the display unit 15*a* below the hands 143 and 144 of FIG. 5 while selectively displaying the hands 143 and 144.

As illustrated in the above-described substantial examples, various modes may be provided to the user by controlling the display of the screen of the display unit 15*a* while selectively displaying the hands 143 and 144. For example, any one of the hands 143 and 144 and the screen of the display unit 15*a* may selectively be provided to the user. That is, only the screen of the display unit 15*a* may be provided to the user as shown in FIG. 11, and only the hands 143 and 144 may be provided to the user as shown in FIG. 12. Also, both the screen and the hands 143 and 144 may be provided to the user. Various modes based on selective display of the hands 143 and 144 may allow the users to more conveniently and easily use the smart watch 100.

Meanwhile, intended simultaneous provision of the hands and the screen may primarily be achieved by the aforementioned structure of the smart watch 100. However, to achieve the intended technical purpose more specifically, it is required to support a proper control considering the structure and characteristic of the smart watch 100. The smart watch 100 basically accompanies interaction with the user in implementing the function. Therefore, the aforementioned technical purpose may be achieved more effectively and efficiently through optimization of various controls including user environment and user interface. Moreover, user experience for the smart watch 100, such as easiness and convenience in use, may also be improved remarkably. That is, optimized control may increase a product value of the smart watch 100 more greatly. For this reason, a control method for the smart watch according FIGS. 1 to 14 has been developed, and will be described with reference to drawings additionally related to FIGS. 1 to 14. Unless otherwise described, FIGS. 1 to 14 and their descriptions are basically included in the following description of the control method and the following drawings.

Figure 15:
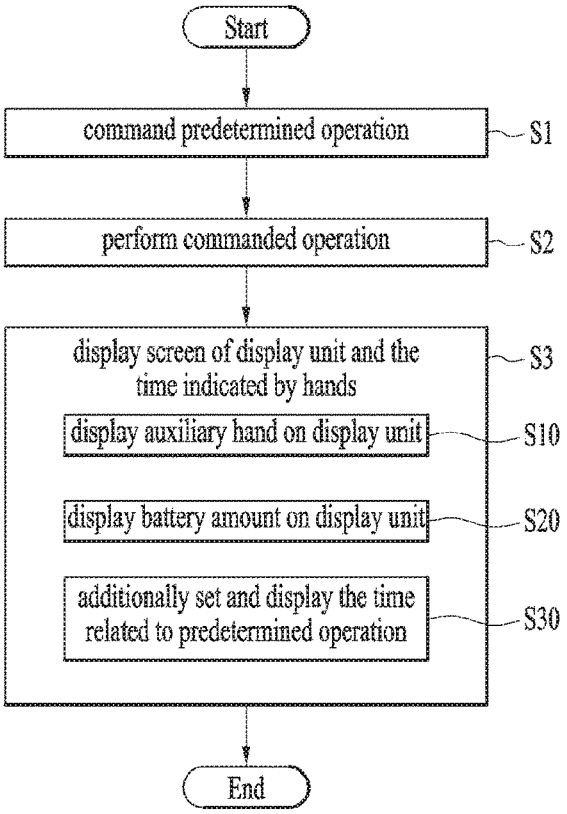
FIG. 15 is a flow chart briefly illustrating an example of a method for controlling a smart watch described in this application.
Figure 16:
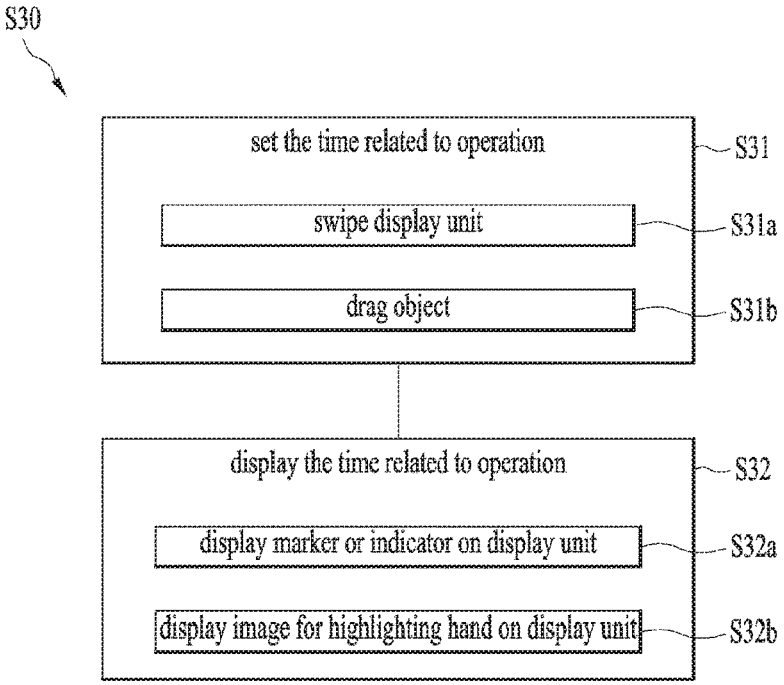
FIG. 16 is a flow chart specifically illustrating a step of additionally setting or displaying the time related to an operation in a method for controlling a smart watch.

FIG. 15 is a flow chart briefly illustrating an example of a method for controlling a smart watch described in this application, and FIG. 16 is a flow chart specifically illustrating a step of additionally setting or displaying the time related to an operation in a method for controlling a smart watch.

First of all, the user may arrange the smart watch 100 on his/her body to use the smart watch 100. That is, the user may wear the watch 100 on his/her wrist, and the control method will be described with reference to the watch 100 worn on the user's wrist. Meanwhile, the user may use the watch 100 by holding the watch 100 with his/her hand instead of wearing the watch 100 on his/her body. Therefore, the control methods described hereinafter may be applied to all types of arrangements or touches of the watch on the user's body including wearing of the watch on the user's wrist.

After wearing the watch, the user may command the smart watch 100 to perform a desired operation (S1). The watch 100 may implement various functions that satisfy the user's need, and the functions may be achieved by an associated operation of predetermined components in the watch 100. Therefore, the user may input a predetermined command in the smart watch 100 to perform an operation for an intended function, whereby the command step S1 may be the most basic step in implementation of the function, especially control. After the command step S1, the watch 100 may perform the commanded operation (S2). In more detail, if the user's command is input to the watch 100, the corresponding components perform the commanded operation in accordance with the input command. Therefore, the finally intended function may be provided to the smart watch 100. The command step S1 may basically be based on the input according to the user's intention and will for a predetermined function. Meanwhile, a request and command for the operation of the watch 100 may be input a network or other device. Therefore, the control method may receive predetermined information or command from an external network or other device. The smart watch 100 may perform the corresponding operation in accordance with the command input in the receiving step.

The screen related to the operation performed to provide the user with the intended function for the step S2 may be displayed on the display unit 15*a*. Also, as described above, the smart watch 100 may continuously display the time through the hands 143 and 144. Therefore, for the step S2, the smart watch 100 may simultaneously provide the user with screen of the display unit 15*a* related to the operation and the current time according to the hands 143 and 144 (S3). Also, since the physical hands 143 and 144 always provide the current time in the smart watch 100, the smart watch 100 may substantially provide the screen of the display unit 15*a* and the time according to the hands 143 and 144 in the step S1 as well as the step S2. The step S3 may include various additional controls to allow the user to effectively use the screen and hands seen to the user, and these control methods will be described hereinafter in detail.

Figure 17:
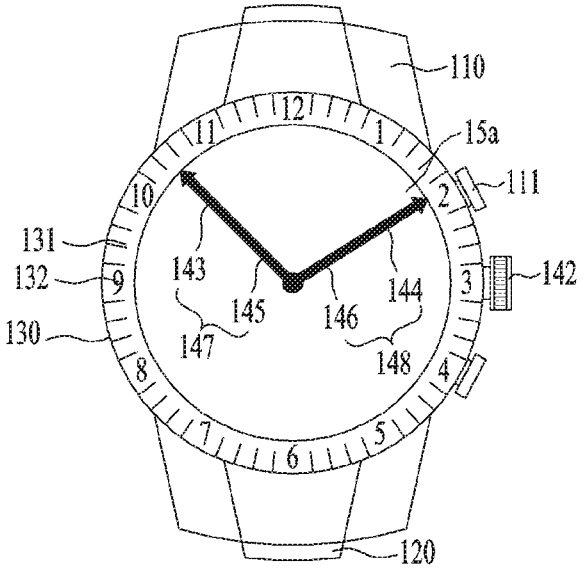
FIG. 17 is a brief view specifically illustrating a step of displaying side hands in addition to physical hands on a display unit.

First of all, in the step S3, the display unit 15*a* may display auxiliary hands 145 and 146 additionally to the hands 143 and 144 (S10). The auxiliary hands 145 and 146 correspond to virtual minute hand and virtual hour hand, and may be aligned in the physical hour hand 143 and the physical hour hand 144 as shown in FIG. 17. Also, the auxiliary hands 145 and 146 may be displayed to be connected with the physical hands 143 and 144, whereby a single hour hand 147 and a single minute hand 148 may be formed together with the physical hands 143 and 144 connected therewith. That is, the auxiliary hand 145 and the physical hand 143 connected with each other may form the single hour hand 147, and the auxiliary hand 146 and the physical hand 144 connected with each other may form the single hour hand 148. Also, the auxiliary hands 145 and 146 may be displayed to move together with the corresponding physical hands 143 and 144. Therefore, the auxiliary hands 145 and 146 may indicate the current time together with the physical hands 143 and 144. For this reason, the smart watch 100 may provide the user with the same effect as the actual analog watch by using the auxiliary hands 143 and 144. Meanwhile, the hour hand 147 and the minute hand 148 formed by the hands 143 and 144 may have their respective colors or thicknesses different from each other to be more clearly identified from each other.

Figure 18:
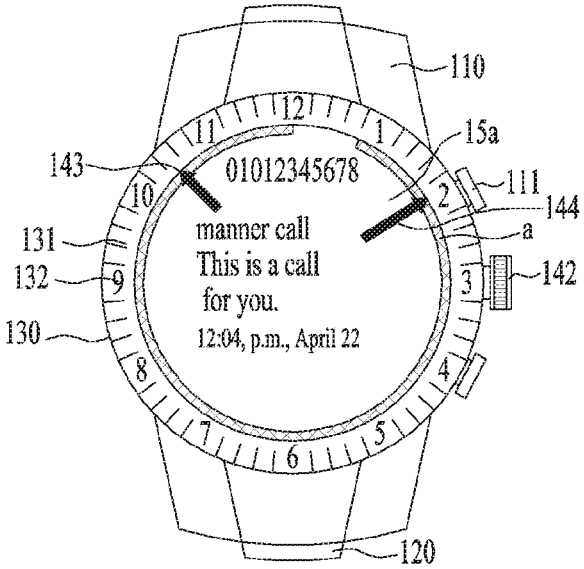
FIG. 18 is a brief view specifically illustrating a step of displaying a battery amount on a display unit.

Also, in the step S3, the display unit 15*a* may display the amount of a battery as soon as it is powered (S20). As described above, the electronic components related to the display unit 15*a* uses a considerable amount of power, and capacity of the battery 19*a* is restricted due to a small size of the smart watch 100. Therefore, a power source should be managed to use the components for a long time if possible prior to charging of the battery 19*a*. For this reason, the display unit 15*a* may be powered on in a special case only in the smart watch 100. For example, when the user sees the display unit 15*a* of the smart watch 100 to check the time or other received notification, the user generally twists a wrist. Therefore, the smart watch 100 may sense this movement by using the sensor and power the display unit 15*a* on. Also, the display unit 15*a* may be powered on a push of the button 111 or a touch on the display unit 15*a*. In this way, it is important to check the mount of the battery in the smart watch 100, as shown in FIG. 18, the display unit 15*a* may display a gauge 'a' for displaying the amount of the battery as soon as it is powered on. This gauge 'a' may display may display the amount of the battery which remains, and may display the amount of the battery by means of color. The user may use the smart watch 100 more conveniently in accordance with the display of the battery amount.

Figure 19:
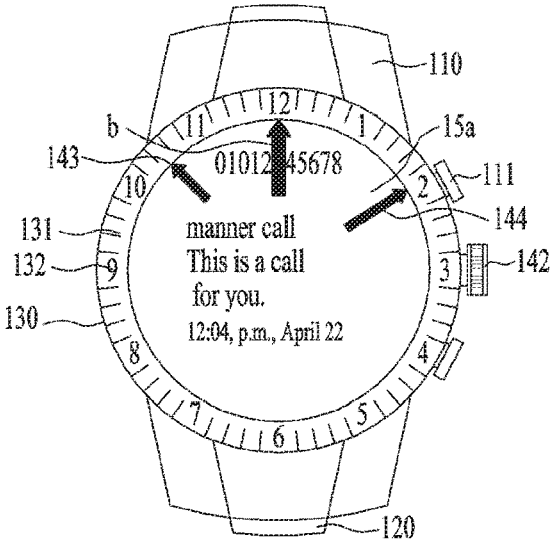
FIG. 19 is a brief view specifically illustrating a step of displaying an indicator indicating an operation related time on a display unit.
Figure 20:
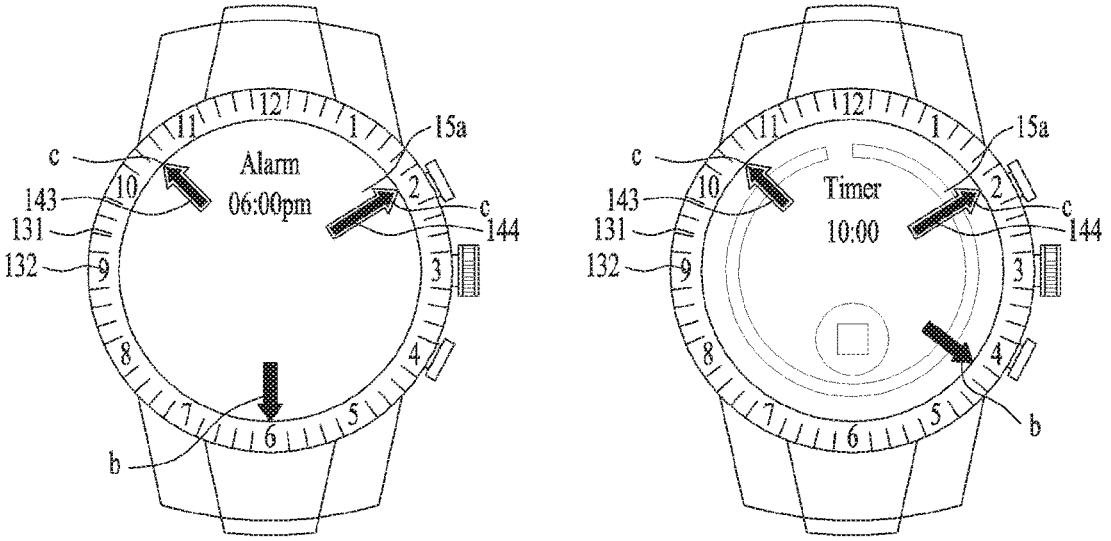
FIG. 20 is a brief view specifically illustrating a step of displaying an image for highlighting physical hands or an indicator on a display unit.

Moreover, in the step S3, the display unit 15*a* may display the time related to a predetermined operation additionally to the current time displayed by the hands 143 and 144 (S30, S32). The time related to a predetermined operation may include the time for performing the predetermined operation or the time for which the predetermined time has been performed. For example, as shown in FIG. 19, the time related to the operation may be the time when a predetermined event or operation is performed or generated, that is, the time when a notification is arrived. Also, as shown in FIG. 20, the time related to the operation may be the time when a predetermined event or operation such as alarm or timer will be generated. Also, in the step S32, the display unit 15*a* may display a marker or indicator 'b' indicating the time related to the operation (S32*a*). The marker or indicator 'b' may display the time related to the operation for the user by indicating an index 132 of the bezel 130 in the same manner as the hands 143 and 144. For example, as shown in FIG. 19, the marker or indicator 'b' may indicate the index 132 corresponding to the time when notification is arrived. Also, as shown in FIG. 20(*a*), the marker or indicator 'b' may indicate the index 132 corresponding to the time when alarm is set, and as shown in FIG. 20(*b*), the marker or indicator 'b' may indicate the index 132 corresponding to the time when the timer ends. Moreover, in the step S32, the display unit 15*a* may highlight the hands 143 and 144 if the time related to the operation approaches (S32*b*). As shown in FIG. 20, the display unit 15*a* may display an image or indicator 'c' for highlighting the hands 143 and 144 if the time related to the operation approaches. In more detail, the user may easily identify the time related to the operation from the time prior to a predetermined time of the time related to the operation, for example 10 minutes ago. For example, as shown in FIG. 20(*a*), the display unit 15*a* may give the image 'c' to the hands 143 and 144 to allow the user to easily recognize the approaching event from the time prior to the time related to the operation displayed by the indicator 'b', that is, 10 minutes ago. Similarly, as shown in FIG. 20(*b*), the display unit 15*a* may give the image 'c' to the hands 143 and 144 from the time related to the operation displayed by the indicator 'b', that is, corresponding to 10 minutes ago of an ending time of the timer.

Figure 21:
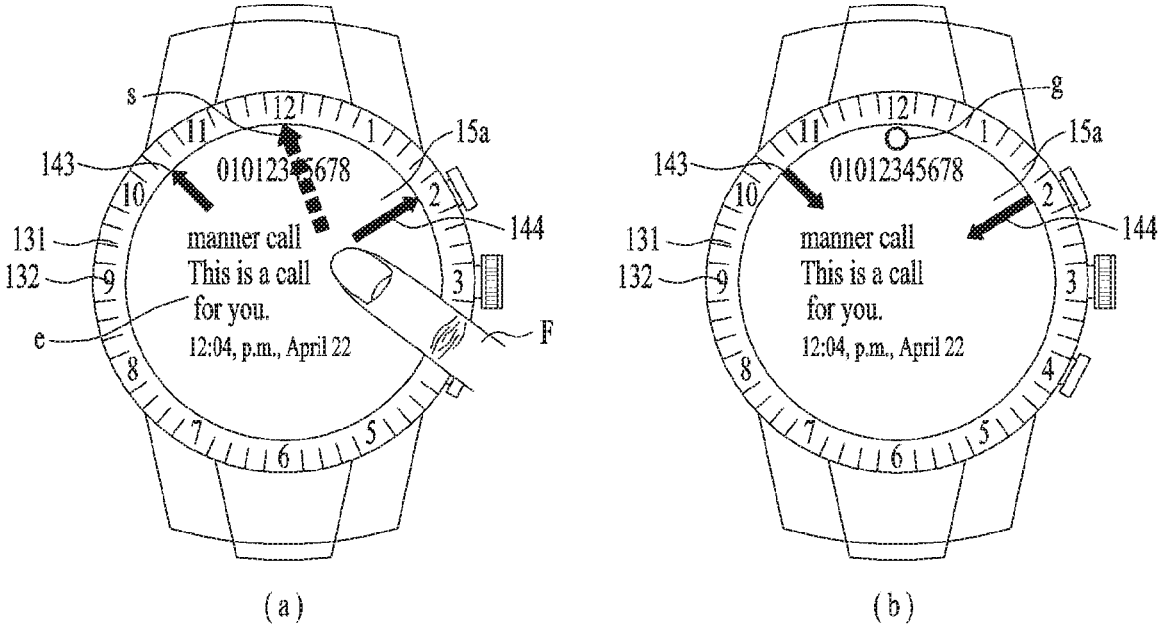
FIG. 21 is a brief view specifically illustrating a step of setting an operation related time by using a display unit.

Meanwhile, in the step S3, the time related to the operation may be set prior to the step S32 (S30, S31). In the step S31, the user may swipe the display unit 15*a* to set the time related to the operation. For example, as shown in FIG. 21(*a*), the user may swipe (S) the display unit 15*a* toward the index 132 of the bezel 130 corresponding to a desired time by using a finger F. The user may set the time when the operation will be performed or the time when the operation has been performed by means of the swipe (S). Also, in the step S31, the user may drag an object 'e' displayed on the display unit 15*a* to set the time related to the operation. For example, as shown in FIG. 21(*a*), the user may drag the object 'e' toward the index 132 of the bezel 130 by using the finger F. The time related to the operation related to the object 'e' may be set by this drag. For example, if the object 'e' is a notification, the time when the notification is generated may be set by drag of the object e'. Meanwhile, the time when the notification will be notified to the user may be set. In this way, if the time related to the operation is set by swipe (S) or drag, as shown in FIGS. 19 and 20, the indicator 'b' may be displayed on the display unit 15*a*. Also, as shown n FIG. 20(*b*), if a plurality of indicators should be displayed, an indicator 'g' having a shape or color different from that of the indicator 'b' may be displayed on the display unit 15*a*, whereby the plurality of indicators may be identified from each other.

In accordance with the steps S30, S31 and S32, the user may easily identify the time related to the operation additionally to the current time according to the physical hands 143 and 144. Therefore, the user may use the smart watch 100 more conveniently.

As described with reference to all the drawings, the smart watch 100 structurally includes both the physical watch and the mobile terminal. As the smart watch 100 configures the physical watch optimally, the hands 143 and 144 of the physical watch do not interfere with the screen of the display unit 15*a*. Therefore, the smart watch 100 may effectively provide the user with the time according to the physical hands 143 and 144 and the function as the mobile terminal implemented through the display unit 15*a* at the same time.

Also, the control method of the smart watch 100 may optimally control the physical hands 143 and 144 and the screen of the display unit 15*a* considering their structural characteristics. Therefore, the control method may allow the user to efficiently use the functions of both the physical watch and the mobile terminal, and moreover may provide easiness and convenience in use.

The above detailed descriptions are to be considered in all respects as illustrative and not restrictive. The scope of the invention should be determined by reasonable interpretation of the appended claims and all change which comes within the equivalent scope of the invention are included in the scope of the invention.

What is claimed is:

1. A smart watch comprising:

a case;

at least one hand configured to indicate current time;

a movement located inside the case and configured to move the at least one hand; and a display unit located in the case and configured to display various kinds of information, wherein the at least one hand is arranged to be spaced apart from a center of the case to adjoin an inner circumference of the case, and revolves around the center of the case along the inner circumference of the case to indicate the current time, and wherein the at least one hand and a screen of the display unit are simultaneously viewable by a user.

2. The smart watch according to claim 1, wherein the at least one hand is arranged on an outer circumference of the display unit, and wherein the at least one hand is extended from the inner circumference of the case to the center of the case.

3. The smart watch according to claim 1, wherein the at least one hand is configured to be pointed toward an index displayed on a bezel installed in the case to indicate the current time.

4. The smart watch according to claim 1, wherein the at least one hand includes a single hand simultaneously indicating hour and minute, or an hour hand and a minute hand, which respectively indicate hour and minute.

5. The smart watch according to claim 1, wherein the movement is further configured to use mechanical energy or a second power source that is separate from a first power source for the display unit, and the smart watch further comprises:

a first battery configured to supply the first power source to the display unit and components associated with the display unit;

a second battery configured to supply the second power source to the movement; and a crown operably connected with the movement and configured to control the at least one hand.

6. The smart watch according to claim 1, wherein the display unit is arranged to cover the at least one hand, and configured as a transparent display.

7. The smart watch according to claim 6, wherein the display unit is further configured to control transparency of the transparent display.

8. The smart watch according to claim 6, wherein the display unit is further configured to display a dark background screen such that the transparent display becomes opaque.

9. The smart watch according to claim 6, further comprising a dispersion panel arranged between the display unit and the at least one hand and configured to scatter incident light to cause the transparent display to become opaque or to have reduced transparency.

10. The smart watch according to claim 6, wherein the at least one hand is selectively viewable by the user.

11. The smart watch according to claim 6, wherein any one of the at least one hand and the screen of the display unit is selectively viewable by the user.

12. The smart watch according to claim 6, wherein the display unit has reduced transparency or becomes opaque so that the at least one hand is not viewable by the user, and wherein the display unit displays the screen according to a predetermined operation performed when the display unit has the reduced transparency or becomes opaque.

13. The smart watch according to claim 6, wherein the display unit has partially reduced transparency or partially becomes opaque so that an additional function provided from the movement is viewable by the user.

14. The smart watch according to claim 6, wherein the display unit maintains a transparent state so that the at least one hand is viewable by the user, and wherein the display unit is powered off to maintain the transparent state.

15. The smart watch according to claim 14, wherein the display unit displays the screen according to a predetermined operation while maintaining the transparent state such that the hand is viewable by the user.

16. The smart watch according to claim 1, wherein the display unit is further configured to:

display an auxiliary hand aligned with the at least one hand to indicate the same current time as the at least one hand; and display capacity of a battery as soon as the display unit is powered on.

17. The smart watch according to claim 1, wherein the display unit displays time related to a predetermined operation in addition to the current timed indicated by the at least one hand, the time related to the predetermined operation including time when the predetermined operation will be performed or time when the predetermined operation has been performed.

18. The smart watch according to claim 17, wherein the display unit displays a marker or indicator pointing toward an index displayed on a bezel installed in the case to indicate the time related to the predetermined operation.

19. The smart watch according to claim 17, wherein the display unit displays an image for highlighting the at least on hand when a difference between the current time and the time related to the predetermined operation is less than a threshold time.

20. The smart watch according to claim 17, wherein the time related to the predetermined operation is set prior to display of the time related to the predetermined operation, and wherein the time related to the predetermined operation is set by swiping the display unit toward an index of a corresponding time displayed on the bezel installed in the case or dragging an object on the display unit to the index of the corresponding time.

* * * * *